United States Patent [19]

Dill et al.

[11] Patent Number: 4,462,297

[45] Date of Patent: Jul. 31, 1984

[54] ELECTRONIC METRONOME

[76] Inventors: Etienne Dill; Pascal Dill, both of 5, rue Kleber, 93500 Pantin, France

[21] Appl. No.: 263,583

[22] Filed: May 14, 1981

[30] Foreign Application Priority Data

May 22, 1980 [FR] France ..... 80 11466

[51] Int. Cl.[3] ..... G10B 15/00

[52] U.S. Cl. ..... 84/484; 84/1.03; 340/384 R

[58] Field of Search ..... 84/1.01, 1.03, 484, 84/DIG. 12

[56] References Cited

U.S. PATENT DOCUMENTS

| | | | |
|---|---|---|---|
| 3,467,959 | 9/1969 | Zazofsky | 340/384 |
| 3,478,633 | 11/1969 | Mallett | 84/1.03 |
| 3,540,344 | 11/1970 | Veech | 84/484 |
| 4,018,131 | 4/1977 | Cannon | 84/484 |
| 4,095,501 | 6/1978 | Aoki | 84/1.03 |
| 4,141,273 | 2/1979 | Austin | 84/484 |

FOREIGN PATENT DOCUMENTS

| | | |
|---|---|---|
| 2608043 | 9/1977 | Fed. Rep. of Germany . |
| 1226875 | 6/1959 | France . |
| 1451344 | 6/1965 | France . |
| 2161502 | 6/1973 | France . |

OTHER PUBLICATIONS

Elektor, vol. 4, No. 7/8, Jul./Aug. 1978, "Metronome", pp. 7–10.

*Primary Examiner*—Russell E. Adams
*Attorney, Agent, or Firm*—James & Franklin

[57] ABSTRACT

A trigger-type oscillator circuit, which can be adjusted to a predetermined frequency, is connected to a circuit for generating audible and/or visual bips at the predetermined frequency. A pedal-type synchronized triggering remote control unit is connected to the oscillator such that the metronome can be triggered or stopped by an instrumentalist without releasing the instrument.

8 Claims, 6 Drawing Figures

ELECTRONIC METRONOME

The present invention relates generally to metronomes and more particularly to electronic metronomes of the synchronized control type.

Conventional metronomes were for a long while constructed using a clock machinery. Some ten years ago, mechanical metronomes were replaced by electronic metronomes, which are more accurate and do not require to rest on a strictly horizontal surface as mechanical metronomes. Moreover, electronic metronomes have the advantage of being of reduced size and relatively low cost. On the other hand, they also have the drawback that the instrumentalist must release the instrument to put the metronome out of action, this involving a loss of time and an undesirable interruption during the performance of a piece of music.

Conventional metronomes are devices which, once set to the desired frequency, will permanently produce audible bips at regular intervals. Heretofore, with such a metronome, the musician who had started the latter was thus bound to adjust his performance to the steady frequency of the beats emitted and any variation of pace was excluded, this imposing to the music a strict character which is quite extraneous thereto. Indeed, musical language involves numerous circumstances wherein it is advisable to alter the regularity of its proceeding (cadences, pauses, slowings or other changes notified in writing on the partition). In such conditions, the instrumentalist should be able to interrupt (momentarily or definitively) the production of audible bips for complying with the pace changes and to reinstate the metronome at the precise time when he choses to resume the initial tempo. Now, with conventional metronomes, or mechanical or electronic type, the instrumentalist cannot alter the pace with respect to the initial tempo while pursuing his performance. Such metronomes do not either enable the instrumentalist to check whether he has resumed the correct tempo after a change in pace without stopping his performance.

One object of the present invention is to provide an electronic metronome enabling an instrumentalist to start or stop said metronome at any time without releasing his instrument.

Another object of the invention is to provide an electronic metronome enabling an instrumentalist to resume a tempo initially defined by the metronome at a precise moment selected by him after a change in pace.

A further object of the invention is to provide an electronic metronome allowing for exact synchronization of the bips emitted by the metronome with the instrumentalist's performance.

Another object of the invention is to provide an electronic metronome of small bulk and low cost.

According to the present invention, an electronic metronome for producing bips at a predetermined frequency is characterized in that it includes a trigger-type oscillator circuit with a means for adjusting the predetermined frequency, which is connected to means for generating audible and/or visual bips and to a pedal-actuated, synchronized, triggering remote-control unit whereby the metronome can be triggered or stopped at any moment by an instrumentalist without necessity for the latter to release his instrument.

Further features and advantages of the present invention will be set forth in the following description, given by way of non restrictive example, with reference to the appended drawings wherein.

Figure 1:
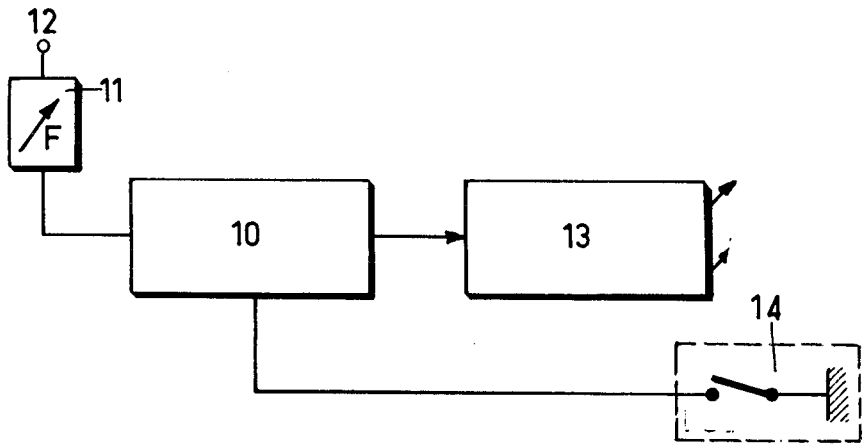
FIG. 1 is a block diagram showing one exemplary embodiment of an electronic metronome according to the present invention.

In FIG. 1, an electronic metronome according to the invention includes a trigger-type oscillator circuit 10 connected to a frequency adjusting means 11 in turn connected to a terminal 12 for a D.C. supply voltage V, to means for generating audible and/or visual bips 13 and to a pedal-actuated, synchronized, triggering remote-control unit 14.

Figure 2:
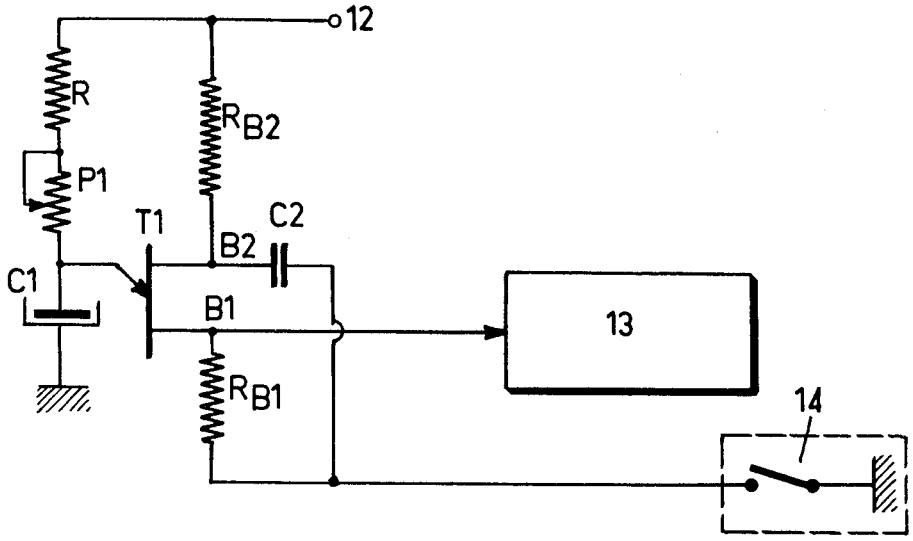
FIG. 2 shows a first exemplary embodiment of a trigger type oscillator circuit of the electronic metronome of FIG. 1.

FIG. 2 shows a first exemplary embodiment of the trigger-type oscillator circuit 10 of FIG. 1. This circuit includes an unijunction transistor T1 having its emitter connected to the supply voltage terminal 12 through the frequency adjusting means 11 which includes a potentiometer P1, connected to terminal 12 and to ground via a resistor R and a condenser C1, respectively. The base B2 of transistor T1 is connected on the one hand to the terminal 12 for supply voltage V through a resistor $R_{B2}$ and on the other hand to the pedal-actuated remote-control unit 14 through a condenser C2. Base B1 of transistor T1 is also connected to the pedal-actuated remote-control unit 14 through a resistor $R_{B1}$, and to the input of bip-generating means 13. The circuit in FIG. 2 allows the metronome to be synchronized by means of remote-control pedal 14 by lowering the peak or triggering voltage of transistor T1 to its minimum value and by charging condenser C1 to its maximum value so as to avoid any delay between the actuation of the pedal and the discharge of condenser C1. Indeed, since the pedal is connected to ground by its actuation, capacitor C2 as well as resistor $R_{B1}$ will be connected to ground and a negative pulse will thus be sent to base B2 of transistor T1, this lowering the B1-B2 voltage so that peak voltage Vp is reduced to its minimal value. When the pedal is not actuated, base B1 of transistor T1 is in the air, so that condenser C1 cannot discharge. Said condenser will thus charge up to its maximum value, i.e. to the value of supply voltage V. Therefore, when the pedal is actuated, discharge of condenser C1 is instantaneous.

Figure 3:
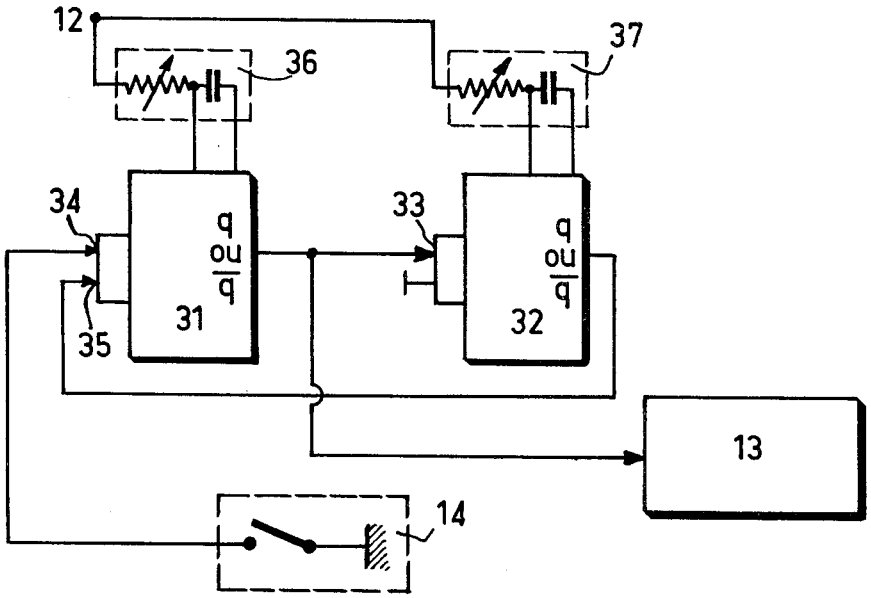
FIG. 3 shows a second exemplary embodiment of the trigger type oscillator circuit of the electronic metronome of FIG. 1.

FIG. 3 shows a second exemplary embodiment of the trigger-type oscillator circuit 10 in FIG. 1. Circuit 10 consists of two monostable circuits 31 and 32 the first circuit 31 having its Q or Q output connected on the one hand to an input 33 of second circuit 32 and on the other hand to the bip-generating means 13 of FIG. 1, and having one input 34 connected to the pedal-type remote-control unit 14 in FIG. 1 and a second input 35 connected to the Q or Q output of circuit 32 (according as the inputs of circuits 31 and 32 are operative on a rising or a falling edge). The time-constant of circuit 31 is adjusted through an external circuit 36 with a resistor and a condenser connected to terminal 12 for the supply voltage V. This time-constant of circuit 31 controls the duration of each bip emitted by means 13. The time-constant of second circuit 32 is adjusted by an external circuit 37 with a resistor and a condenser connected to terminal 12 for the supply voltage V, which is for instance of 9 volts.

This time-constant of circuit 32 controls the repetition rate of the bips emitted by means 13. To construct circuit 10 of FIG. 3, use may be made of two monostable circuits integrated by a technology of the CMOS complementary-symmetry metal-oxyde semi-conductor type or of the TTL transistor-transistor logic type.

Figure 4:
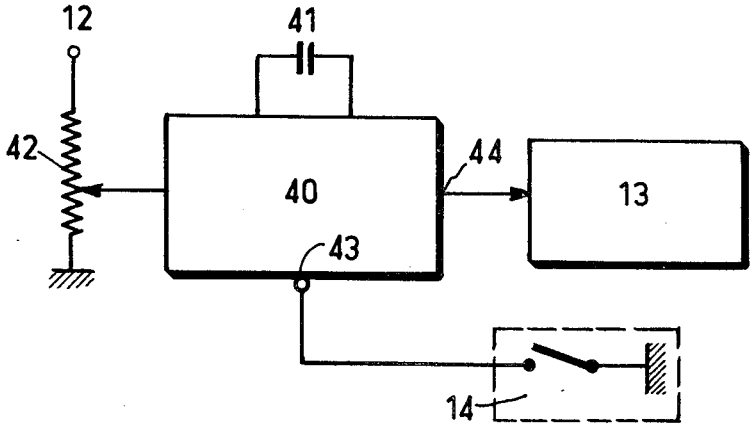
FIG. 4 shows a third exemplary embodiment of the trigger type oscillator circuit of the electronic metronome of FIG. 1.

FIG. 4 shows a third exemplary embodiment of the trigger-type oscillator circuit 10 of FIG. 1. Circuit 10 consists of an integrated voltage-controlled oscillator 40, of a known type such as 74 S124 of Texas Instruments, having externally connected thereto a condenser 41 and a frequency-adjusting potentiometer 42 connected between terminal 12 of FIG. 1 and the ground. An enabling input 43 and an output 44 of oscillator 40 are connected to the pedal of remote-control unit 14 and to the bip-generating means 13 of FIG. 1, respectively.

Figure 5:
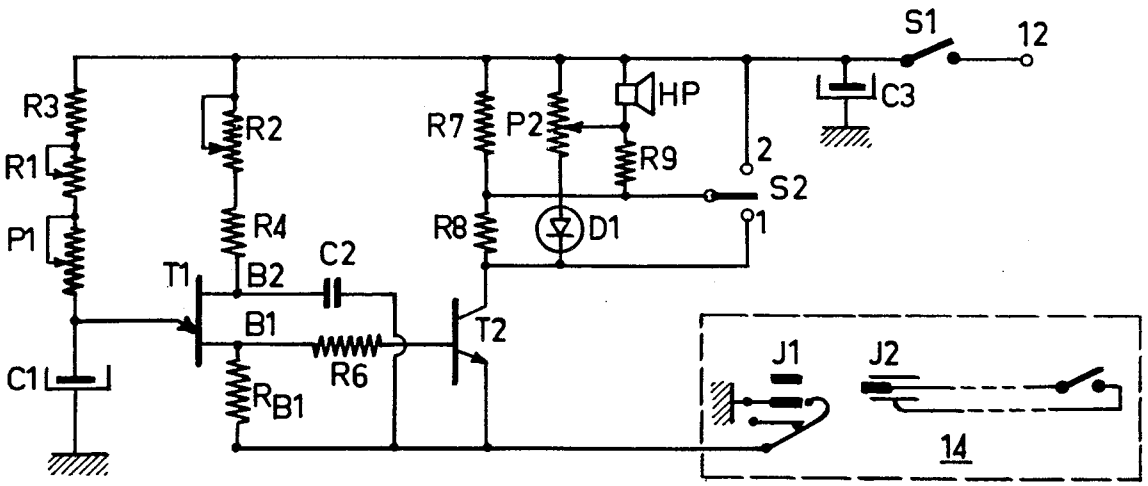
FIG. 5 is a detailed diagram of an exemplary embodiment of an electronic metronome according to the present invention which includes the trigger type oscillator circuit of FIG. 2.

FIG. 5 is a detailed diagram of an electronic metronome according to the invention including the trigger-type oscillator circuit of FIG. 2. Resistor R of FIG. 2 consists, in FIG. 5, of resistors R3 and R1 series-connected between terminal 12 and potentiometer P1. Resistor $R_{B2}$ of FIG. 2 consists of resistors R2 and R4 series-connected between terminal 12 and base B2 of transistor T1. In the preferred embodiment of the invention, shown in FIG. 5, resistors R1 and R2 are adjustable resistors for calibrating the metronome at high frequencies and at low frequencies, respectively. It is possible, for example, to adjust the value of resistor R2 so that the maximum position of potentiometer P1 corresponds to the lowermost frequency selected, and to adjust the value of resistor R1 so that the minimum position of potentiometer P1 corresponds to the uppermost frequency selected. Said lowermost and uppermost frequency values are, for example of the order of 40 bips per minute and 208 bips per minute, respectively. Thus, selection of frequencies other than the limiting frequencies can be made by rotating a graduated dial fast with potentiometer P1. The accuracy of the graduations is dependent on the accuracy to which potentiometer P1 is linear, viz. 5%. The benefit in having two adjusting resistors R1 and R2 to calibrate the metronome at high frequencies and low frequencies respectively is to allow selection of such limiting frequencies as afford very accurate variation of the operating frequency.

The bip-generating means 13 of FIG. 1 comprise, in FIG. 5, a transistor T2 of an amplifier circuit connected to base B1 of transistor T1 through a resistor R6. The emitter of transistor T2 is connected, as condenser C2 and resistor $R_{B1}$, to the pedal-type remote-control unit 14, that is to the ground when the pedal is actuated. Collector of transistor T2 is connected to a visual bip emitting circuit comprising an electroluminescent diode LED with a frosted glass D1 and a resistor R8 in parallel, and to an audible bip emitting circuit comprising a loudspeaker HP and a series resistor R9 which are in parallel with a resistor R7 and a potentiometer P2 for adjusting the sound volume of the loudspeaker. The circuits for emitting both the visual and audible bips are in series between the V supply terminal 12 and the collector of transistor T2 when a selector switch S2, consisting of a three-position switch, is in its intermediate position. In position 1 of selector switch S2, the audible bip emitting circuit is directly connected between terminal 12 and the collector of transistor T2 and the loudspeaker can emit audible bips. In position 2 of selector switch S2, the visual bip emitting circuit is directly connected between terminal 12 and the collector of transistor T2 and the diode can emit visual bips. Remote-control unit 14 has the pedal of FIG. 1 connected to ground by interengagement of two female and male J1 and J2 and actuation of the pedal. It should however be noted that the metronome is also adapted to operate by direct connection of condenser C2, resistor $R_{B1}$ and the emitter of transistor T2 to the ground through a switch of jack plug J1, without intervention of the pedal. Also provided in the metronome of FIG. 5 is a switch S1 located between terminal 12 and selector switch S2 for the switching on of the device. Potentiometer P2 permits to adjust the sound volume of the loudspeaker without thereby substantially affecting the light intensity of diode D1 which was selected of the frosted glass type so as to cause broad spreading of the illumination and increase the light perception angle.

In a preferred exemplary embodiment of the present invention, the mean power consumption is at the lowermost frequency of 1.6 mA and, at the uppermost frequency, it is of 3.8 mA. The instantaneous sound level is of 2 W during 150 μs. In the case where the loudspeaker HP and the diode are on, the mean sound level at the lowermost frequency is of 10 mW. In the case where only the loudspeaker HP is on, said level is of 13 mW. At the uppermost frequency, the mean sound level is of 25 mW when the loudspeaker HP and the diode are on. When only the loudspeaker HP is on, said level is of 32 mW at the uppermost frequency. On the other hand, it will be appreciated that when the pedal is not actuated, there is no power consumption.

The just-described exemplary embodiment of the invention includes an oscillator directly triggered by the pedal-type remote-control unit connected thereto by an electric wire. This trigger-type oscillator whereof three exemplary embodiments were described with reference to FIGS. 2, 3 and 4 could also be a high frequency oscillator.

Figure 6:
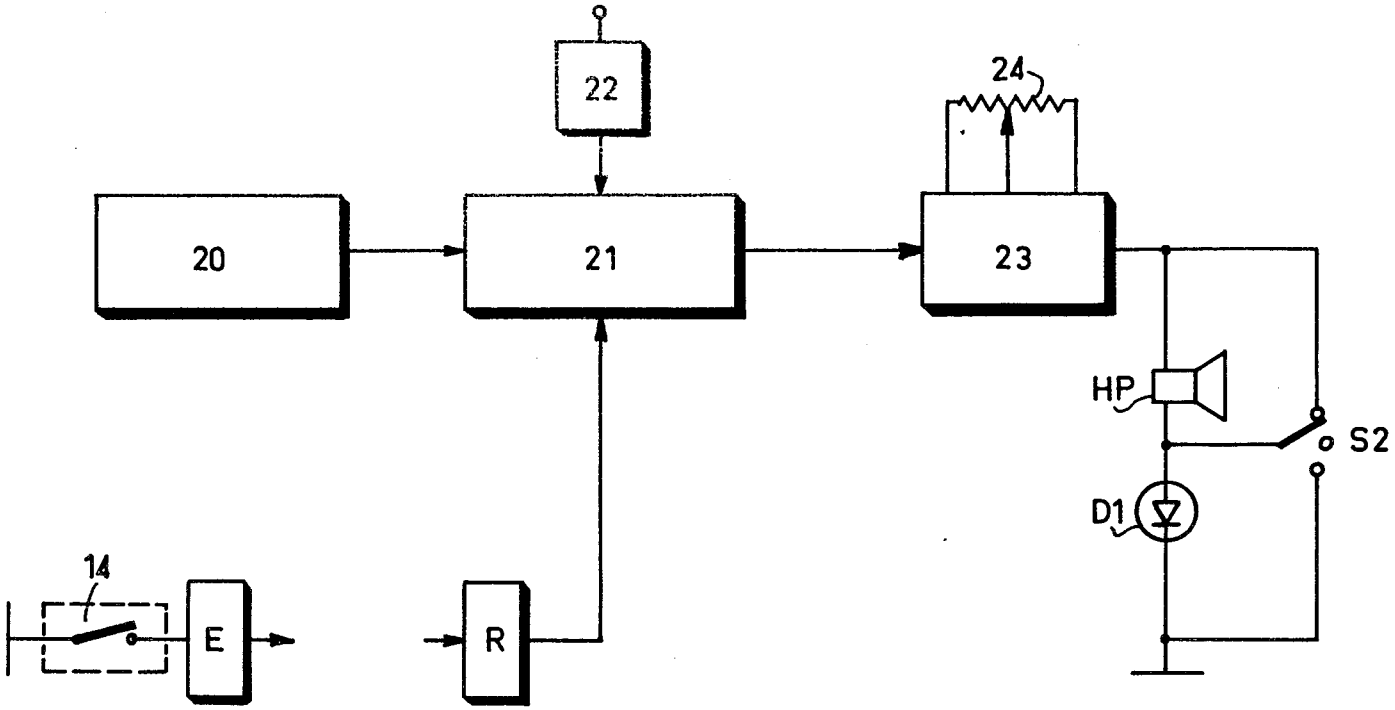
FIG. 6 is a block diagram of another exemplary embodiment of an electronic metronome according to the present invention.

In another exemplary embodiment of the invention, shown in FIG. 6, the wire-connection is replaced by a wireless connection and the directly triggered oscillator is replaced by a high frequency quartz oscillator whereof the subsequent stages are triggered by the remote-control unit. In FIG. 6, the pedal-type remote-control unit 14 of FIGS. 1 to 5 is connected to the metronome electronic circuit by a transreceiver system E-R which may be of the electromagnetic, optical, ultrasonic or other type. A high frequency quartz oscillator 20, of conventional design, is connected to a synchronization circuit with frequency dividers 21 for supplying pulses adjusted to a suitable frequency by a frequency-adjusting means 22 when a synchronizing signal originating from the pedal and transmitted by the transreceiver system E-R. is received by circuit 21. The output of circuit 21 is connected to an amplifier 23 for the loudspeaker HP having its sound volume adjusted by a means 24. The circuit of loudspeaker HP is moreover connected to a diode circuit D1 and to a selector-switch S2 allowing one and/or the other circuit to be switched on for emitting audible and/or visual bips.

The invention is not limited to the above-described exemplary embodiments. Indeed, modifications may be brought thereto, within the scope of the invention, provided that a synchronizing remote-control unit with a pedal is used to trigger an oscillator, or stages following the oscillator, which is coupled to a suitable adjustment means. Such an electronic metronome has the major advantage of freeing the musician from the subjection imposed thereto by the conventional metronome and thus affords more numerous further possible uses without thereby distracting the musical character of the study.

What we claim is:

1. An electronic metronome for producing bips at a predetermined frequency comprising an oscillator circuit, means operably connected to said oscillator circuit for adjusting the frequency of said oscillator circuit, means operably connected to the output of said oscillator circuit for generating audible and/or visual bips and a pedal-type synchronized remote control unit, operably connected to trigger said oscillator circuit, said oscillator circuit comprising a uni-junction transistor having a base, and a capacitor, said base being operably connected to said remote control unit through said capacitor.

2. The metronome of claim 1, for use in conjunction with a DC voltage supply, wherein said uni-junction transistor comprises an emitter and wherein said frequency adjusting means comprises a potentiometer operably interposed between said emitter of said uni-junction transistor and the DC voltage supply, and first and second resistor means operably connected to said uni-junction transistor for defining the limits of the frequency range through which said oscillator circuit may be adjusted.

3. The metronome of claim 1, wherein said bip generating means comprises amplifier means operably connected to said oscillator circuit, a loudspeaker, a photo-emitting diode, and a selector switch, said selector switch being operatively interposed between said amplifier means, on the one hand, and said loudspeaker and said photo-emitting diode, on the other hand, such that the actuation of said switch selectively operatively connects the output of said amplifier means with said loudspeaker and/or said diode.

4. The metronome of claim 3, wherein said diode comprises a frosted glass type electro-luminescent diode.

5. The metronome of claim 3, further comprising a potentiometer for adjusting the volume of said loudspeaker.

6. The metronome of claim 1, wherein said remote control unit comprises switch means for operatively grounding said oscillator circuit and pedal means for operably grounding said oscillator circuit.

7. The metronome of claim 1, wherein said remote control unit comprises a foot pedal, a transmitter operatively connected to said foot pedal and adapted to be actuated thereby, and a receiver operably connected to said oscillator circuit and adapted to trigger said oscillator circuit when said receiver receives a signal from said transmitter.

8. An electronic metronome for producing bips at a predetermined frequency, for use with a DC voltage supply, comprising a trigger-type oscillator circuit, means connected to said oscillator circuit for adjusting the frequency of said oscillator circuit, means for generating audible and visible bips, said bip generating means being operably connected to the output of said oscillator circuit, a synchronizing circuit operably connected to said oscillator circuit, and foot actuator control means adapted to trigger said oscillator circuit in synchronization through said synchronizing circuit, said foot actuated control means comprising a pedal-type synchronized triggering remote control unit located remotely from said metronome, said oscillator circuit comprising a uni-junction transistor having a base and an emitter, and a capacitor, said base being connected to said remote control unit through said capacitor, said frequency adjusting means comprising a potentiometer, and first and second resistor means, said potentiometer being operably interposed between said emitter of said uni-junction transistor and said DC voltage supply, said first and second resistor means being operably connected between said supply and said oscillator for defining the limits of the frequency range of said oscillator.

* * * * *